United States Patent [19]

Schippers et al.

[11] Patent Number: 4,697,753

[45] Date of Patent: Oct. 6, 1987

[54] STEPPED PRECISION WINDING PROCESS

[75] Inventors: Heinz Schippers; Seigmar Gerhartz, both of Remscheid; Rolf Kalthoff, Wermelskirchen, all of Fed. Rep. of Germany

[73] Assignee: Barmag AG, Remscheid, Fed. Rep. of Germany

[21] Appl. No.: 838,390

[22] Filed: Mar. 11, 1986

[30] Foreign Application Priority Data

Mar. 11, 1985 [DE] Fed. Rep. of Germany ..... 3508554
Aug. 14, 1985 [DE] Fed. Rep. of Germany ..... 3529117

[51] Int. Cl.[4] ..... B65H 54/38
[52] U.S. Cl. ..... 242/18.1; 242/43 R
[58] Field of Search ..... 242/18.1, 18 DD, 43 R

[56] References Cited

U.S. PATENT DOCUMENTS 4,371,122 2/1983 Schuller ..... 242/43 R
4,504,021 3/1985 Schippers et al. ..... 242/18.1
4,504,024 3/1985 Gerhartz ..... 242/18.1
4,515,320 5/1985 Slavik et al. ..... 242/18.1

FOREIGN PATENT DOCUMENTS 0055849 12/1981 European Pat. Off. .
2649780 5/1977 Fed. Rep. of Germany .

*Primary Examiner*—Stanley N. Gilreath
*Attorney, Agent, or Firm*—Bell, Seltzer, Park & Gibson

[57] ABSTRACT

The invention provides an improved method for winding synthetic yarns and wherein the yarn is wound about a core at a substantially constant rate while the yarn is guided onto the core by a traversing yarn guide. The speed of the traversing yarn guide is proportional to the rotation of the package to define a substantially constant winding ratio during a series of sequential steps, and the speed of the traversing yarn guide is rapidly increased at the beginning of each of the sequential steps to produce a stepped precision wind. The upper and lower values of the traversing speed are both changed in a predetermined manner during the winding cycle, and so as to form a cylindrical package without harmful yarn patterns or bulges.

8 Claims, 3 Drawing Figures

STEPPED PRECISION WINDING PROCESS

Figure 1:
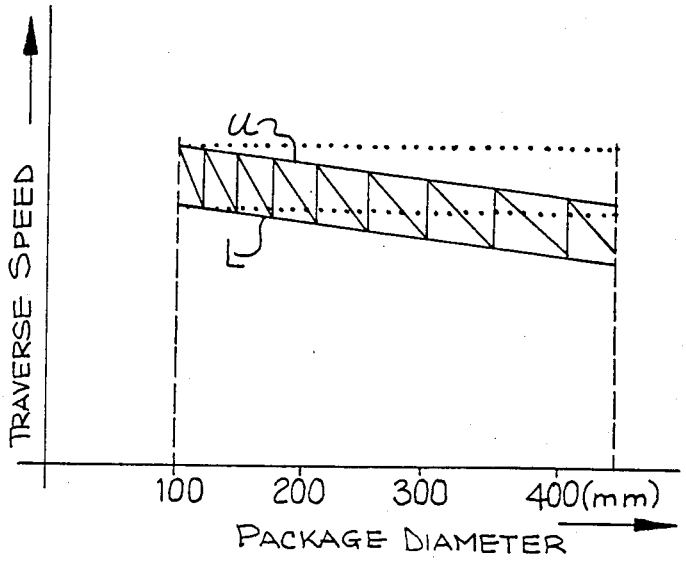

The winding method which is the subject of this invention is particularly useful in winding yarns, particularly synthetic filament yarns in spinning and drawing machines. Synthetic yarns are yarns of thermoplastic materials such as polyester and polyamides. Each of the yarns consists of a plurality of individual filaments and they are commonly called multifilament yarns.

In winding such synthetic multifilament yarns, there arises the problem of pattern or "ribbon" formation when they are randomly wound. When being randomly wound, the packages are formed at a constant yarn traversing rate and at a constant circumferential package speed, but with the winding spindle speed gradually decreasing as the package builds. As a result, the winding ratio, i.e. the ratio of the speed of the winding spindle to the doublestroke rate of the yarn traversing system, decreases constantly during the winding cycle. Ribbons form when the winding ratio becomes an integral number or reaches values which differ by a large fraction, for example, one-half, one-third and one-fourth from the next integral winding ratio.

In a precision wind, the package is built at a yarn traversing rate which is directly proportional to the speed of the winding spindle. This means that in a precision wind, the winding ratio is a fixed value and remains constant during the course of the winding cycle. Maintaining a fixed winding ratio requires that the yarn traversing rate decrease proportionately to the spindle speed with the winding ratio as the factor of proportionality. A package formed by a precision winding process may have advantages over a package built by random winding. In particular, in a precision wind, formation of ribbons is avoided by the selection of the winding ratio.

In a stepped precision wind, the winding cycle is divided into steps with the winding ratio remaining constant during each step. From step to step, the winding ratio is reduced in jumps by suddenly increasing the yarn traversing speed. As a result, a precision wind occurs within each step during which the yarn traversing rate is decreased proportionally to the winding spindle speed. At the end of each step, the yarn traversing speed is suddenly increased so that a decreased winding ratio results. In so doing, the winding ratios which are to be maintained during the individual steps must be predetermined.

A winding method is disclosed in German AS No. 26 49 780 which utilizes a stepped precision wind having only a few winding ratios which are integral ratios. This is possible since the yarn tension is simultaneously and independently regulated. However, when simultaneous and independent yarn tension control is not utilized, the jumps in the yarn traversing speed must be selected sufficiently small so that the yarn tension remains within certain acceptable limits. It is also necessary to avoid winding ratios which result in the formation of ribbons.

Another prior art winding method is disclosed in EP-A No. 2 55 849 which provides a stepped precision wind in which the package is driven at a constant circumferential speed. In so doing, the yarn traversing speed is repeatedly varied between a constant upper limit and a constant lower limit. However, this publication also suggests that the jumps in the winding ratio, i.e., the changes in the traversing speed between the steps, become less as the diameter of the package increases. This means that the upper limit of the yarn traversing speed is lowered during the course of the winding process. However, this winding method has been found to have little influence on the package build, and it does not avoid possible defects in the form of castoffs or slipping layers. More specifically, "castoffs" are described to be yarn lengths that protrude in the area of yarn reversal from the end face of the package and span secantially over the end face of the package. Slipping layers develop when the yarn deposited at the ends of the package move axially toward the center, with earlier wound layers being pushed over later wound layers, which in turn leads to unwinding problems.

It is accordingly an object of the present invention to provide a stepped precision winding process which overcomes the above limitations of the prior art methods.

It is a more particular object of the present invention to provide a stepped precision winding process which is adapted to produce an essentially cylindrical package without harmful surface patterns or bulges on its end faces, and which permits the formation of packages of very large diameter.

These and other objects and advantages of the present invention are achieved in the embodiments illustrated herein by the provision of a winding method which includes winding a textile yarn into a core supported package and wherein the yarn is wound about the core at a substantially constant rate while the yarn is guided onto the core by a traversing yarn guide, and wherein the speed of the traversing guide is decreased in proportion to the decreasing rotational speed of the package to define a substantially constant winding ratio during each of a series of sequential steps of the winding cycle, and with the speed of the yarn traversing guide rapidly increasing at the beginning of each sequential step to produce a stepped precision wind. The method includes the further step of changing the upper and lower limits of the yarn traversing speed in the same direction of change during at least a portion of the winding cycle. The direction of change is predetermined by experience.

More specifically, experience has shown that in some winding applications the upper and lower limits should be reduced especially toward the end of the winding cycle, such as after the package diameter reaches certain dimensions, for example, 300 mm. In case of textured yarns, the winding process and resulting package may be improved by increasing the upper and lower limits of the yarn traversing rate as the package diameter increases. In other winding applications, experience has indicated that the winding process and resulting package are improved by first increasing and then decreasing the upper and lower limits during the winding cycle.

In implementing the process which is the subject matter of this application, it is necessary that the upper and lower limits of the yarn traversing speed and the changes in the upper and lower limits of the yarn traversing speed during the winding cycle be selected such that critical yarn tensions are avoided. In one implementation of the invention, critical yarn tensions are avoided by limiting the rate of change in the upper and lower limits of the yarn traversing speed such that the lower limit never exceeds the initial upper limit during a portion of the winding cycle in which the upper and lower limits are being increased or conversely, the upper limit does not decrease below the initial lower limit during a portion of the cycle when the upper and lower limits are being decreased.

Bulges sometimes develop on the face of the package when the yarn does not deposit in the area near the ends of the package in accordance with the ideal law of yarn deposit. In particular, these defects occur when the reverse in the yarn is not accomplished with a small radius. Rather, the yarn tends to slip by reason of its tension, and move on its underlayer from the ends of the package in a direction toward the center of the package and to form a yarn portion at the end of the package having a large radius of curvature. Accordingly, the formation of a bulge not only depends on the parameters of the winding method, but also on yarn parameters particularly the friction coefficient of the yarn on its underlayer. As the size of the package increases, the formation of bulges becomes more serious. One result of bulge formation is an intolerable decrease in the yarn tension as the winding cycle progresses.

Decreases in yarn tension resulting from bulge formation may be compensated by increasing the upper and lower limits of the yarn traversing speed. As a result, the present invention provides a method which increases the maximum diameter of a package which can be wound without objectionable bulge formation.

In practicing the invention, the upper and lower limits of the yarn traversing speed are varied in the same direction, with the change in yarn traversing speed providing the steps in the winding ratio remaining substantially constant in magnitude. As a result, the rates of change of the upper and lower limits of the yarn traversing speed are substantially equal, and the upper and lower limits form parallel or conforming paths when plotted on a diagram of traversing speed versus time or package diameter. The actual yarn traversing speed thus remains within a band of substantially constant width. It is preferred to rapidly increase the yarn traversing speed at the beginning of each step to the upper limit, then lower the yarn traverse rate proportionally to the decreasing spindle speed until it approaches the lower limit, and to then again suddenly increase the yarn traversing speed back to the upper limit at a safety distance prior to reaching the lower limit.

Figure 2:
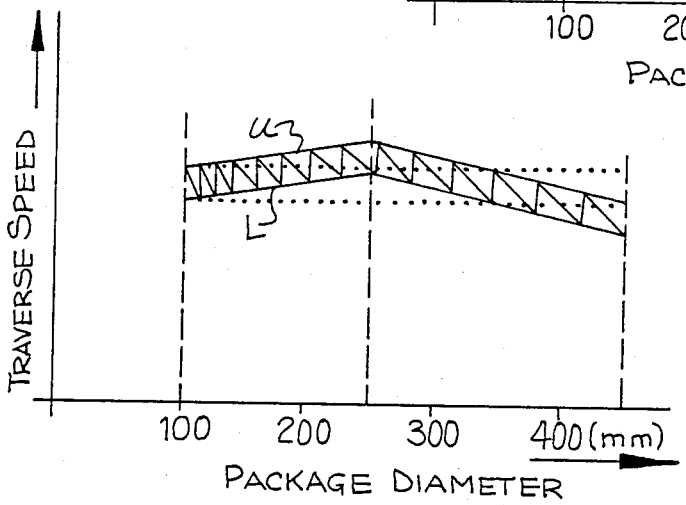
Figure 3:
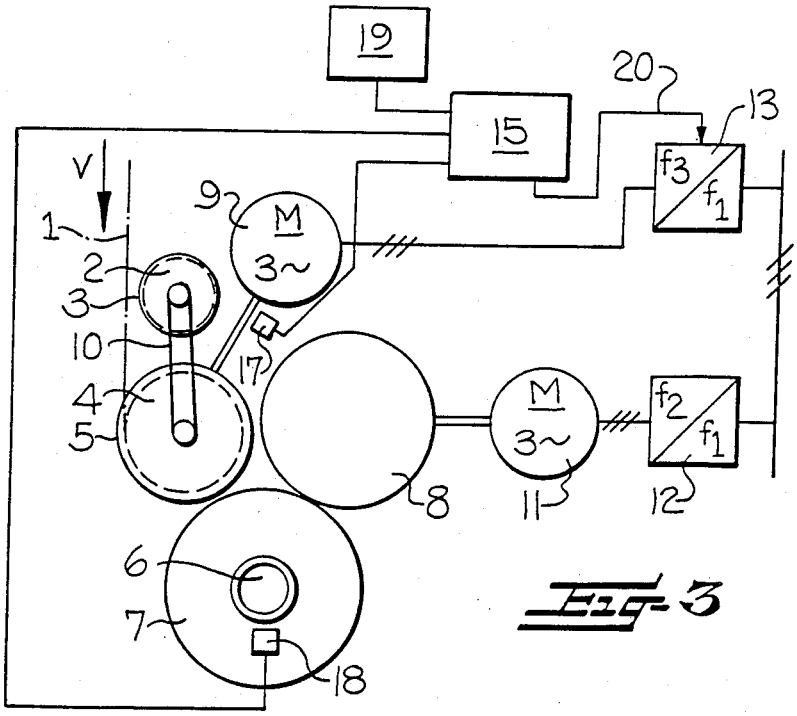

Some of the objects and advantages of the present invention having been stated, others will appear as the description proceeds, when taken in conjunction with the accompanying drawings, in which FIG. 1 is a diagram of traverse speed versus package diameter of a winding process, and with the traversing speed being maintained in accordance with a first embodiment of the invention;

FIG. 2 is a similar diagram wherein the traversing speed is maintained in accordance with a second embodiment of the invention; and FIG. 3 is a schematic illustration of a typical winding machine adapted to perform the method of the present invention.

In the yarn winder illustrated schematically in FIG. 3, the yarn 1 advances at a constant speed v through a yarn guide 3 which is reciprocated transversely to the direction of the yarn by a cross spiraled roll 2. After passing through the yarn guide 3, the yarn passes over a grooved roll 4 and is partially looped in its endless reciprocating groove 5. After passing over the grooved roll 4, the yarn is wound onto a package 7 which is driven at a constant circumferential speed by a drive roll 8 contacting the outer surface of the package 7. The package 7 is mounted on a package winding spindle 6, and the drive roll 8 and the package winding spindle 6 are radially movable with respect to the package 7 so that the distance between the package winding spindle 6 and the drive roll 8 can vary as the diameter of the package 7 increases during the winding cycle.

A three-phase motor 9, which may be an asynchronous motor, drives the grooved roll 4. A belt 10 couples grooved roll 4 to the cross spiraled roll 2 to provide drive therefore. A second drive motor 11, which may also be a three-phase synchronous motor, is coupled directly to the package drive roll 8 which in turn drives the package 7 at a constant circumferential speed. Electrical power to drive the package drive motor 11 is provided by a first inverter 12. The three-phase output voltage of the first inverter 12 has an adjustable frequency f2 selected to give the package drive motor 11 the desired rotational speed. Primary electrical power for the first inverter 12 is provided by a three-phase power bus at any convenient voltage and frequency f1.

A second inverter 13 also receives its primary electrical power from a primary power bus at a convenient voltage and frequency. The output voltage of the second inverter 13 is preferably constant with the frequency f3 controlled such that the yarn traversing system drive motor 9 rotates at the speed required to produce the desired yarn traversing rate.

A measuring sensor 18 is provided for monitoring the speed of the spindle 6, and the sensor 18 provides an output signal to the computer 15. The output signal from the programming unit 19 also is coupled to the computer 15, and the programming unit 19 is preferably freely programmable and supplied with the winding ratios which are to be successively run in the individual phases or steps during the course of the stepped precision winding process. Also, a measuring sensor 17 is provided for monitoring the actual yarn traversing speed, i.e., the double stroke rate, and the output of the sensor 17 is supplied to the computer 15. The computer conducts a comparison between the desired and actual values, and as a result, regulates the speed of the yarn traversing system by means of the motor 9 to achieve the desired value, i.e., a value proportional to the spindle speed as determined by the stored winding ratio for each step of the winding process.

The main task of the computer 15 is to determine the actual value of the yarn traversing speed. To this end, the computer is initially supplied with the stored winding ratios from the programming unit 19, and which are ideal in the meaning of the present invention. From each of these ideal winding ratios, and the output value of the traversing yarn speed, the computer determines "ideal" spindle speeds. However, the programming unit 19 may similarly be supplied with the spindle speeds which are predetermined from the "ideal" winding ratios, so that this operation need not be performed by the computer. In any event, the values of the "ideal" spindle speeds are compared with the actual spindle speeds measured by the sensor 18. When the computer finds that the spindle speeds are identical, it supplies an output signal 20 to the frequency inverter 13 which is indicated by the programming unit 19 to be the nominal value of the traversing speed. During the following step of the winding process, the computer reduces this nominal value proportionally to the constantly measured spindle speed, which decreases hyperbolically as the package diameter increases with a constant circumferential speed of the package. Thus during this step of the winding process, the predetermined "ideal" winding ratio remains constant. As soon as the computer finds that the actually measured spindle speed corresponds with the "ideal" spindle speed of the next step, an output signal 20 is delivered which represents the ideal value of the traversing speed of the next step of the winding process.

As a result of the foregoing, the upper limiting value of the yarn traversing speed is, in the described embodiment, a fixed magnitude, which is repeatedly reached as the winding cycle proceeds. When this magnitude is reached, it is then adjusted along a predetermined ideal value which is related to the actual spindle speed. The lower limiting value of the traversing speed however, is only a calculated magnitude, which indicates the maximum allowable drop in the traversing speed, which in reality is rarely or never reached, and which plays a role only in the calculation of the upper limiting value. It should be mentioned that the method may also be inverted, such that the lower limiting value of the traversing speed may be given as the real, repeatedly reached limiting value, and in this instance, the upper limiting value would indicate the then maximum allowable upward increase of the traversing speed. It is, however, in reality only approached in exceptional situations, when this upper limiting value, as related to the instantaneous spindle speed, happens to have a value which was predetermined as ideal.

In the operation of the described apparatus, different laws of traversing motion may be programmed, as illustrated for example in the diagrams of FIGS. 1 or 2. Referring to FIG. 1, it will be seen that the initial value of the upper limit U of the traversing speed, and the lower limit L of the traversing speed, are not constantly maintained, as would be indicated by the dotted line. Rather, the upper limiting value and the lower limiting value both decrease along a straight line, and in so doing, the upper limiting value does not become less than the initial value of the lower limit, even at the end of the winding cycle. The preprogrammed winding ratios are selected so that the yarn traversing speed to be reached at the beginning of each step is at the upper limiting value of the yarn traversing speed. The lower limiting value of the traversing speed, and wherein at the latest the traversing speed is suddenly increased, decreases substantially parallel to the path of the upper limiting value. The diagram of FIG. 1 involves a package which is wound on a 100 mm diameter tube, and which is wound to reach a final diameter of 450 mm.

Referring to the diagram of FIG. 2, which also applies to a package built from 100 to 450 mm in diameter, the upper and lower limits first increase linearly, and then decrease linearly after the package has reached a diameter of about 250 mm.

It should be noted that the variation of the upper and lower limits need not be linear, but may proceed along any desired curved path. It may in particular be useful to increase the rate of the variation toward the end of the winding cycle only, i.e., at large diameters.

In the drawings and specification, there has been set forth a preferred embodiment of the invention, and although specific terms are employed, they are used in a generic and descriptive sense only and not for purposes of limitation.

We claim:

1. A method of winding a textile yarn into a core supported package and comprising the steps of winding the yarn about the core at a substantially constant rate and such that the rotational speed of the package gradually decreases, while guiding the yarn onto the core by a traversing yarn guide, decreasing the speed of the traversing yarn guide in proportion to the decreasing rotational speed of the package to define a substantially constant winding ratio during each of a series of sequential steps of the winding cycle, rapidly increasing the speed of the yarn traversing guide at the beginning of each sequential step to produce a stepped precision wind and so as to define upper and lower limits of the yarn traversing speed during each sequential step, and changing the upper and lower limits of the yarn traversing speed in the same direction of change during at least a portion of the winding cycle.

2. A winding method in accordance with claim 1 wherein the total change in the value of the upper limit of the yarn traversing speed during the winding cycle, and the total change in the value of the lower limit of the yarn traversing speed during the winding cycle, are each not greater than the difference between the initial upper and lower limits.

3. A winding method in accordance with claim 1 wherein the step changing the upper and lower limits of the yarn traversing speed includes continuously decreasing the upper and lower limites along a predetermined path during at least the end portion of the winding cycle.

4. A winding method in accordance with claim 3 wherein the upper limit of the yarn traversing speed does not decrease below the initial lower limit of the yarn traversing speed during the winding cycle.

5. A winding method in accordance with claim 1 wherein the step of changing the upper and lower limits of the yarn traversing speed includes continuously increasing the upper and lower limits along a predetermined path during at least a portion of the winding cycle.

6. A winding method in accordance with claim 5 wherein the lower limit of the yarn traversing speed does not exceed the initial upper limit of the yarn traversing speed during the winding cycle.

7. A winding method in accordance with claim 1 wherein the step of changing the upper and lower limits of the yarn traversing speed includes increasing the upper and lower limits during the initial portion of the winding cycle and decreasing the upper and lower limits during the later portion of the winding cycle.

8. A winding method in accordance with claim 1 wherein the rates of change of the upper and lower limits of the yarn traversing speed are substantially equal during the winding cycle.

* * * * *